US006849811B1

(12) United States Patent
Heflin et al.

(10) Patent No.: US 6,849,811 B1
(45) Date of Patent: Feb. 1, 2005

(54) METHODS AND APPARATUS FOR TRANSFER SWITCH

(75) Inventors: Chris Heflin, Oak Park, IL (US); Mark A. Serrano, Chicago, IL (US); Ariel M. Gamazon, Chicago, IL (US)

(73) Assignee: General Electric Company, Schenectady, NY (US)

( * ) Notice: Subject to any disclaimer, the term of this patent is extended or adjusted under 35 U.S.C. 154(b) by 374 days.

(21) Appl. No.: 09/629,244

(22) Filed: Jul. 31, 2000

(51) Int. Cl.[7] ..... H01H 9/54

(52) U.S. Cl. ..... 200/1 R; 200/1 V; 200/2; 200/18; 307/64; 307/112

(58) Field of Search ..... 200/1 R–1 V, 200/2–18; 307/64, 112–150

(56) References Cited

U.S. PATENT DOCUMENTS

| | | | | |
|---|---|---|---|---|
| 2,648,747 A | | 8/1953 | Graves, Jr. | |
| 3,459,516 A | | 8/1969 | Ty et al. | |
| 3,676,088 A | | 7/1972 | Pryor et al. | |
| 3,936,782 A | | 2/1976 | Moakler et al. | |
| 4,021,678 A | | 5/1977 | Moakler et al. | |
| 4,032,057 A | * | 6/1977 | Linscott, Jr. | 228/56 |
| 4,041,371 A | * | 8/1977 | Hini | 323/94 |
| 4,059,817 A | | 11/1977 | Hollweck et al. | |
| 4,071,835 A | * | 1/1978 | Russo et al. | 335/133 |
| 4,157,461 A | | 6/1979 | Wiktor | |
| 4,398,097 A | | 8/1983 | Schell et al. | |
| 4,590,387 A | | 5/1986 | Yoshida et al. | |
| 4,747,061 A | | 5/1988 | Lagree et al. | |
| 4,791,255 A | | 12/1988 | Eliezer | |
| 4,804,933 A | | 2/1989 | Becker et al. | |
| 4,808,933 A | | 2/1989 | Kobayashi et al. | |
| 4,808,934 A | | 2/1989 | Yokoyama et al. | |
| 5,038,912 A | | 8/1991 | Cotter | |
| 5,070,252 A | | 12/1991 | Castenschiold et al. | |
| 5,638,948 A | * | 6/1997 | Sharaf et al. | 200/401 |
| 5,784,240 A | | 7/1998 | Przywozny | |
| 5,914,467 A | | 6/1999 | Jonas et al. | |
| 6,024,896 A | * | 2/2000 | Okutomi et al. | 252/516 |
| 6,172,432 B1 | | 1/2001 | Schnackenberg et al. | |

FOREIGN PATENT DOCUMENTS

FR 1285297 2/1962

OTHER PUBLICATIONS

International Search Report, dated Jan. 17, 2002, International Application No.: PCT/US01/24022, General Electric Company.

* cited by examiner

*Primary Examiner*—K. Lee
(74) *Attorney, Agent, or Firm*—Armstrong Teasdale LLP

(57) ABSTRACT

A transfer switch for switching between power sources for a load includes a plurality of symmetrical phase plates, a plurality of stationary contact pads associated with each said phase plate, each stationary contact pad associated with a power source, a movable contact assembly associated with each phase plate, and a shaft connecting the phase plates and upon which each movable contact assembly is mounted for movement between stationary contact pads associated with each phase plate. The above transfer switch allows for two, three and four-pole modular configuration with minimal additional hardware.

28 Claims, 11 Drawing Sheets

METHODS AND APPARATUS FOR TRANSFER SWITCH

BACKGROUND OF THE INVENTION

This invention relates generally to electrical power transfer and, more particularly, to electrical power transfer switches.

Many businesses use transfer switches for switching power sources, for example, from a public utility source to a private secondary supply, automatically within a matter of seconds. Critical loads such as hospitals, airport radar towers, high volume data centers are dependent upon transfer switches to provide continuous power. Transfer switches are common to the power industry. Product lines ranging from 30 to 5,000 amps are currently available in the marketplace. A low cost, high volume, easy to manufacture transfer switch ranging between 225 and 400 amps that provides superior performance would be desired.

BRIEF SUMMARY OF THE INVENTION

A transfer switch for switching between power sources for a load includes a plurality of symmetrical phase plates, a plurality of stationary contact pads associated with each phase plate, each stationary contact pad associated with a power source, a movable contact assembly associated with each phase plate, and a shaft connecting the phase plates and upon which each movable contact assembly is mounted for movement between stationary contact pads associated with each phase plate.

The above transfer switch allows for two, three and four-pole modular configuration with minimal additional hardware.

DETAILED DESCRIPTION OF THE INVENTION

Figure 1:
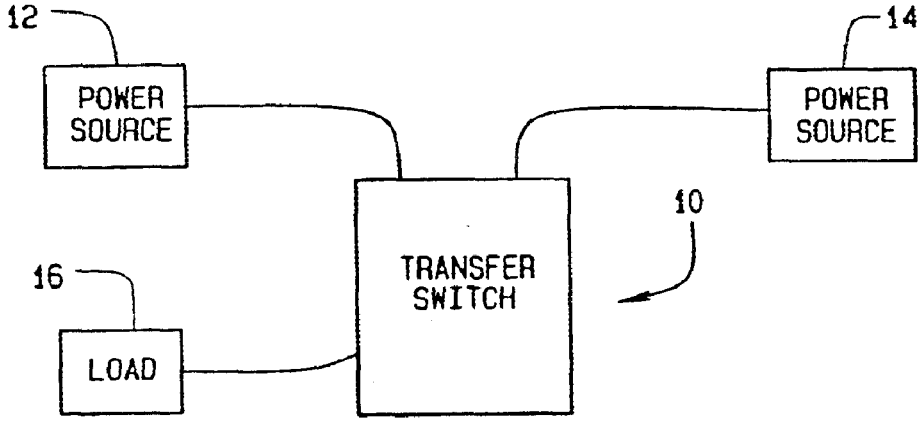
FIG. 1 is a diagram of a typical transfer switch.

FIG. 1 illustrates a typical transfer switch 10 for switching among a plurality of power sources, e.g. between power sources 12 and 14, to supply electrical power to a load 16. For example, load 16 is a hospital, airport radar tower or other continuous electrical power user. Load 16, via switch 10, draws power from source 12 under normal operating conditions. If, for example, power source 12 fails or becomes inadequate to supply load 16, load 16 is transferred via switch 10 to draw power from source 14. When source 12 again provides sufficient power, load 16 is transferred via switch 10 again to draw power from source 12. The foregoing description of transfer switch 10 operation is exemplary only, and additional functions may be performed by transfer switches such as switch 10.

Figure 2:
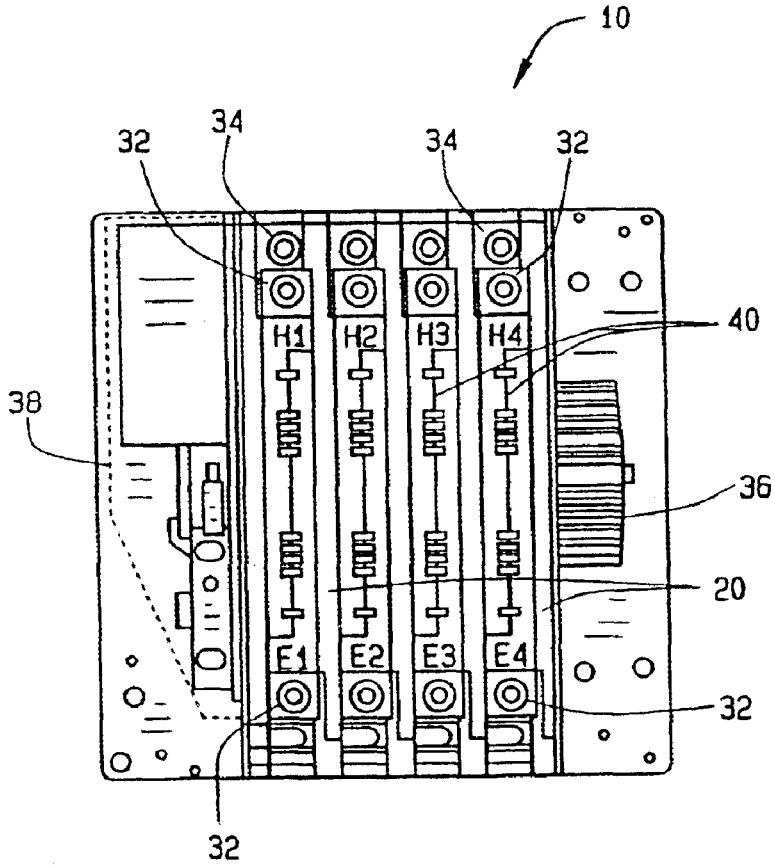
FIG. 2 is a diagram of one embodiment of a transfer switch.

FIG. 2 illustrates one embodiment of transfer switch 10. Switch 10 includes a plurality of phase plates 20, one plate 20 per phase of current to load 16. The embodiment shown in FIG. 2 is a four-pole transfer switch and thus includes four phase plates 20. As further described below, switch 10 is modularly constructed, and other embodiments of switch 10 include, but are not limited to, three-pole switches and two-pole switches (not shown in FIG. 2).

Each plate 20 is associated with a plurality of main bus assemblies 32. Each bus assembly 32 is associated with a power source (not shown in FIG. 2). For example, each phase plate 20 is associated with two main bus assemblies 32 associated respectively with power sources 12 and 14 (shown in FIG. 1). More specifically and as further described below, each main bus assembly 32 connects current between its associated source 12 or 14 and switch 10. Also associated with each phase plate 20 is a load bus assembly 34 that connects current between switch 10 and load 16 (shown in FIG. 1). Switch 10 also includes a limit switch assembly 36, a mechanical drive assembly 38 and a plurality of arc chute assemblies 40, each phase plate 20 associated with an arc chute assembly 40 as further described below.

Figure 3:
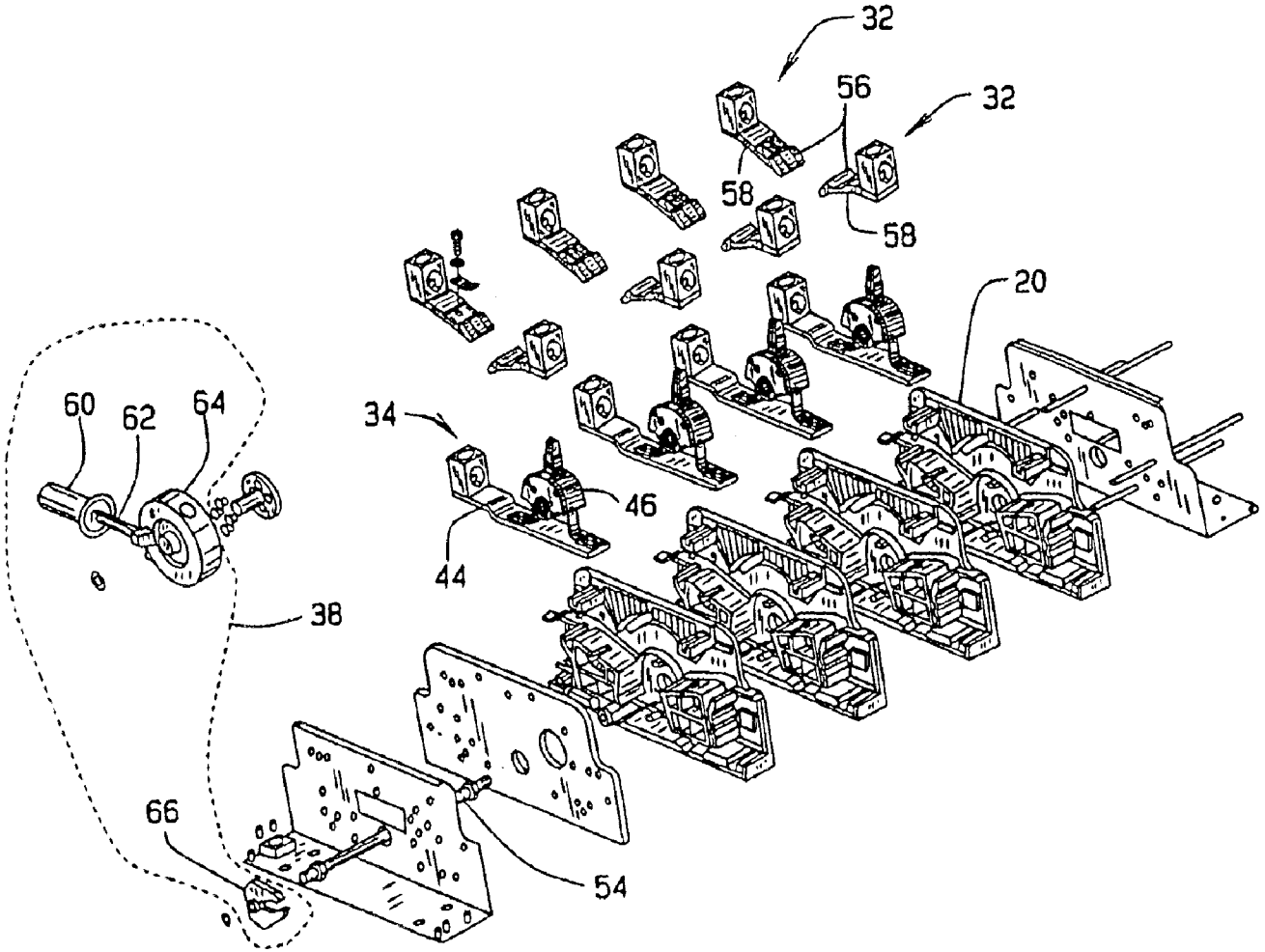
FIG. 3 is an exploded diagram of parts of the transfer switch shown in FIG. 2.

Referring to FIG. 3, each load bus assembly 34 includes a load bus 44 and a movable contact assembly 46. A shaft 54 connects phase plates 20. In one embodiment, shaft 54 is hexagonal. As further described below, each movable contact assembly 46 is mounted on shaft 54 for movement between two main bus assemblies 32. Each main bus assembly 32 includes a stationary contact pad 56 joined to a line bus subassembly 58. Mechanical drive assembly 38 includes a solenoid assembly 60 linked by a link 62 to a mass/momentum driver assembly 64. Mechanical drive assembly 38 also includes a fork assembly 66 mounted on shaft 54.

Figure 4:
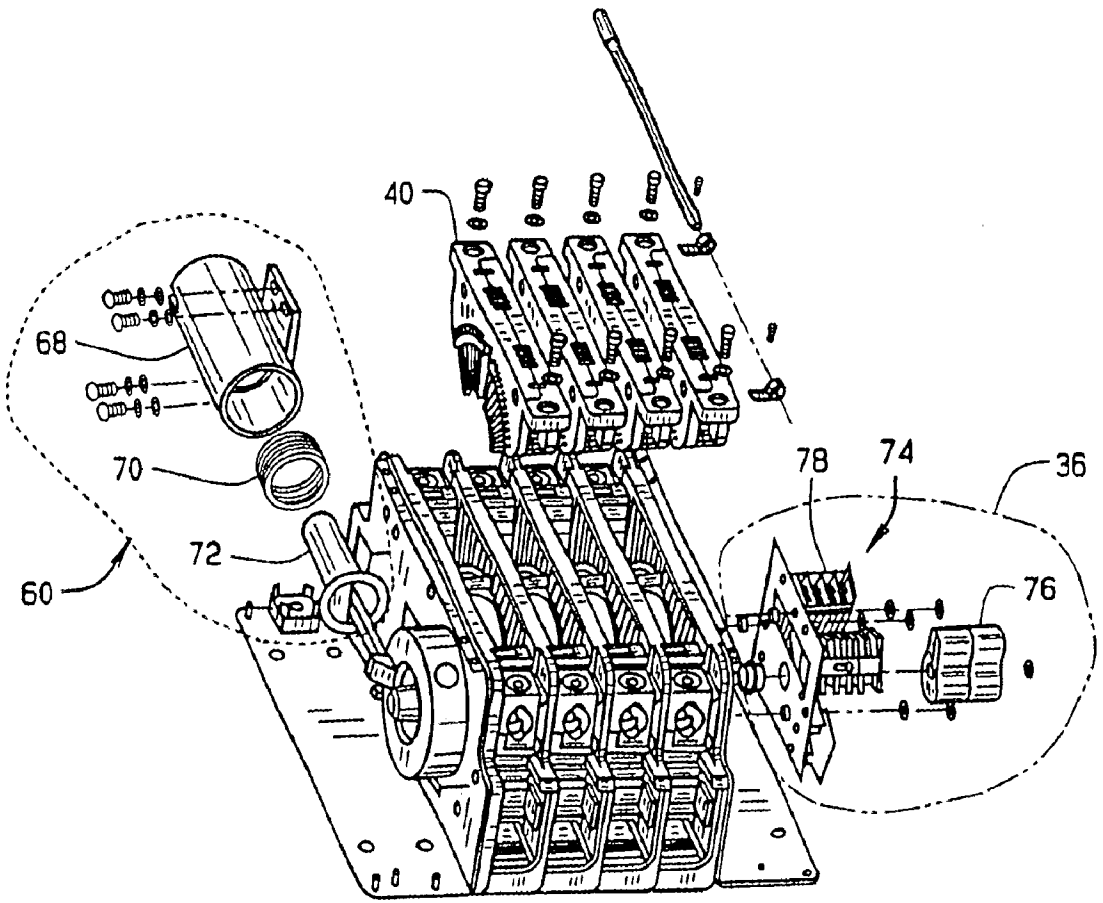
FIG. 4 is an exploded diagram of a transfer switch.

Referring to FIG. 4, solenoid assembly 60 includes a solenoid 68, a return spring 70 that fits inside solenoid 68, and a plunger 72 that fits through the spring. Limit switch assembly 36 includes a limit switch plate assembly 74 and a limit switch-operating cam 76 mounted on common shaft 54. Limit switch plate assembly 74 in one embodiment includes a plurality of limit switches 78 that are mounted modularly onto assembly 74 to provide a plurality of user connections. Cam 76 is fabricated as a single piece and is symmetrical about two centerlines (not shown).

Figure 5:
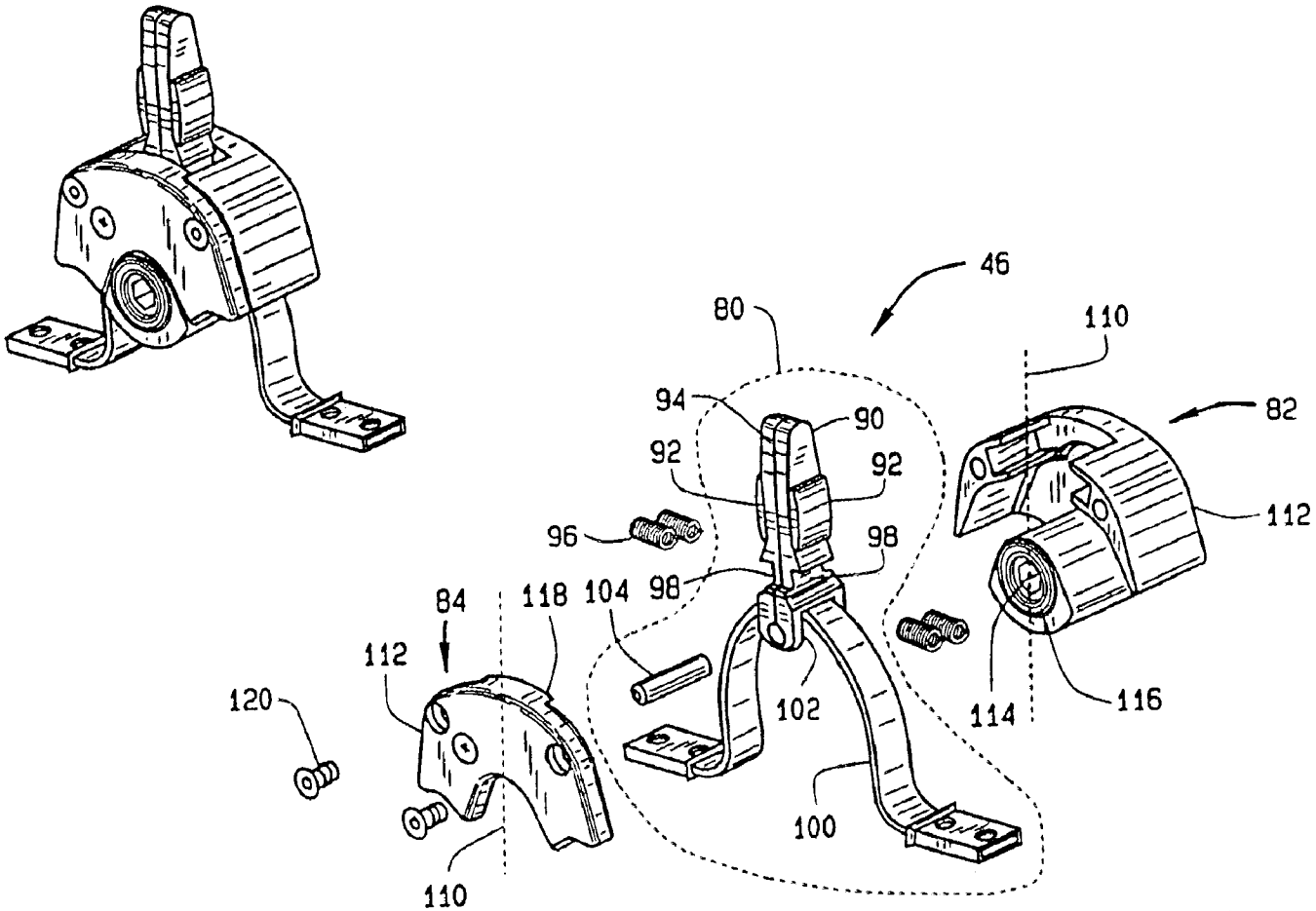
FIG. 5 is a diagram of a movable contact assembly.

Referring to FIG. 5, each movable contact assembly 46 includes a movable finger assembly 80, a carrier 82 and a carrier cover 84. Finger assembly 80 includes a movable finger 90 upon which are mounted two movable contact pads 92 further described below. Finger 90 is symmetrical about a centerline 94. Contact springs 96 are nested into nesting pockets 98 and are enclosed within carrier 82. Finger assembly 80 also includes a braid assembly 100 movably attached to finger 90 in a nesting pocket 102 formed by a pivot 104 upon which finger 90 is mounted.

Carrier 82 and carrier cover 84 are symmetrical about a centerline 110 and include braid shields 112 for protection against heat and arcing. Carrier 82 is fabricated as a single part and includes an acceptance hole 114 for shaft 54. In one embodiment both shaft 54 and hole 114 are hexagonal, thus contributing to holding an electrical contact closed during, e.g. intense short circuit blow open conditions. Carrier 82 also includes integral baffling 116 to prevent gases and other foreign objects from coming in contact with common shaft 54, e.g. during short circuit conditions. Carrier cover 84 includes embedded aligning features 118 for ease of assembly. Embedded inserts 120 connect cover 84 to carrier 82. When assembled, movable contact assembly 46 is symmetrical about centerlines 94 and 110 for ease of installation onto load bus 44, and contact springs 96 are self-aligned within carrier 82.

Figure 6:
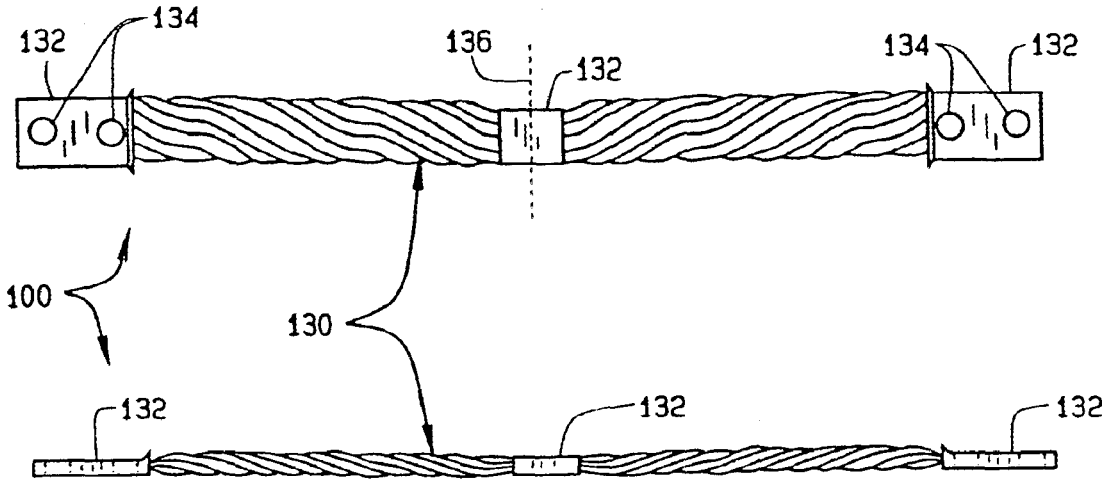
FIG. 6 is a diagram of a braid assembly.

Referring to FIG. 6, braid assembly 100 includes a single-piece braid 130 onto which ferrules 132 are slipped and crimped to increase holding power and reduce interface resistance for power transfer via switch 10. Double mounting ports 134 prevent rotation of braid assembly 100. Braid assembly 100 is symmetrical about a centerline 136.

Figure 7:
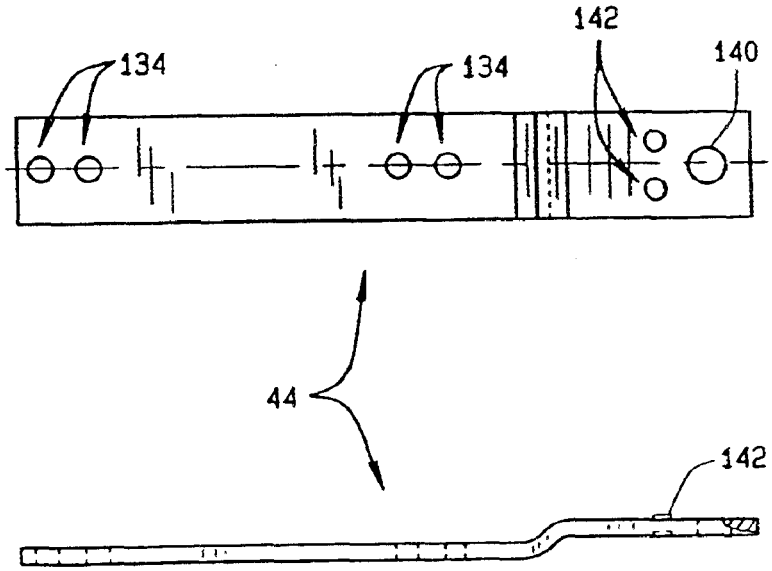
FIG. 7 is a diagram of a load bus.

Referring to FIG. 7, load bus 44 is fabricated of a single piece of copper and includes a single lug attachment point 140 for connecting to load 16 (shown in FIG. 1). Bus 44 also includes integral projections 142 for preventing lug rotation.

Figure 8:
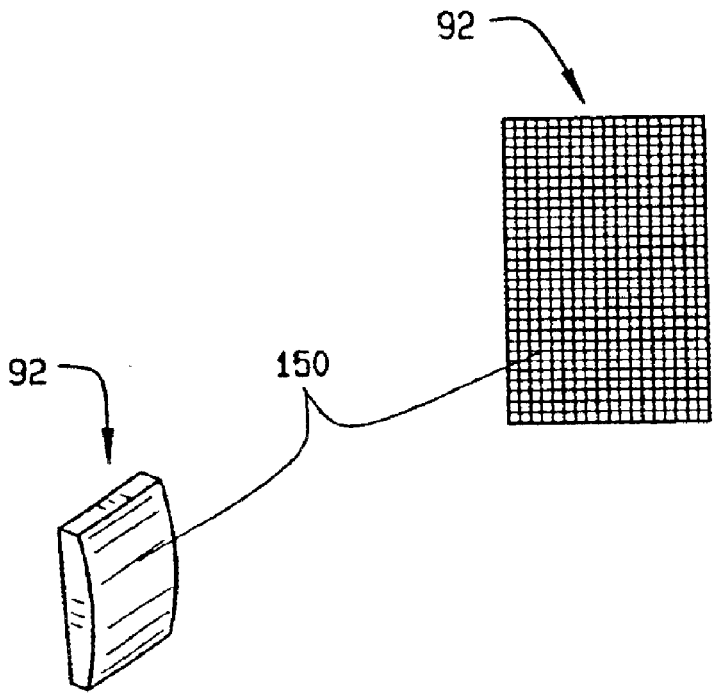
FIG. 8 is a diagram of a movable contact pad.

FIG. 8 illustrates one of movable contact pads 92. Pad 92 is composed e.g. of 40 percent silver and 60 percent tungsten by weight. Pad 92 includes a curved surface 150 e.g. having a waffled pattern and brazed by flushing with a BcuP5 alloy.

Figure 9:
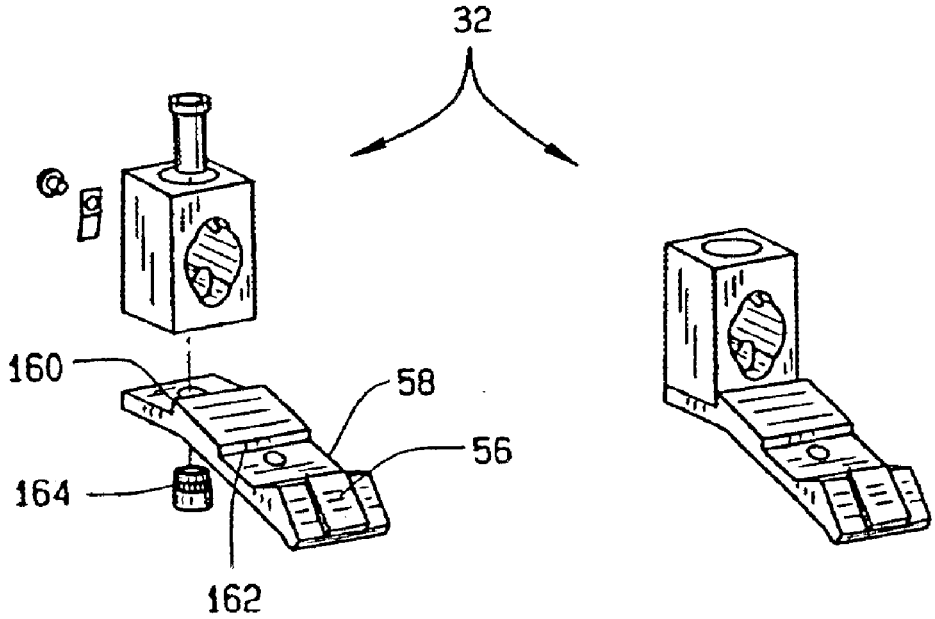
FIG. 9 is a diagram of a main bus assembly.

FIG. 9 illustrates main bus assembly 32. Line bus subassembly 58 in one embodiment is fabricated as a single brazed piece and includes a mechanical lug anti-rotation surface 160 and an arc runner anti-rotation surface 162. Main bus assembly 32 includes a single lug attachment point 164 for connecting to power source 12 or 14 (shown in FIG. 1).

Figure 10:
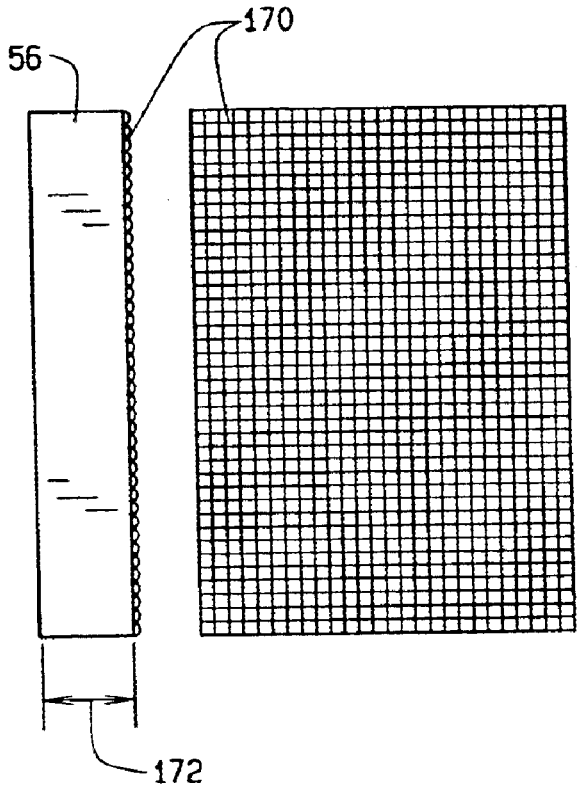
FIG. 10 is a diagram of a stationary contact pad.

FIG. 10 illustrates stationary contact pad 56, composed a material capable of connecting fully rated motor loads and 100 percent tungsten loads at current levels up to and including 400 amps. Contact pad in one embodiment is composed of 50 percent silver, 37.5 percent tungsten and 12.5 percent tungsten carbide by weight. Pad 56 includes a surface 170 e.g. having a waffled pattern and brazed by flushing with a BcuP5 alloy. For reasons described below, a thickness 172 of pad 56 is e.g. 0.156 inches for use with a phase current and 0.186 inches for use with a neutral current.

Figure 11:
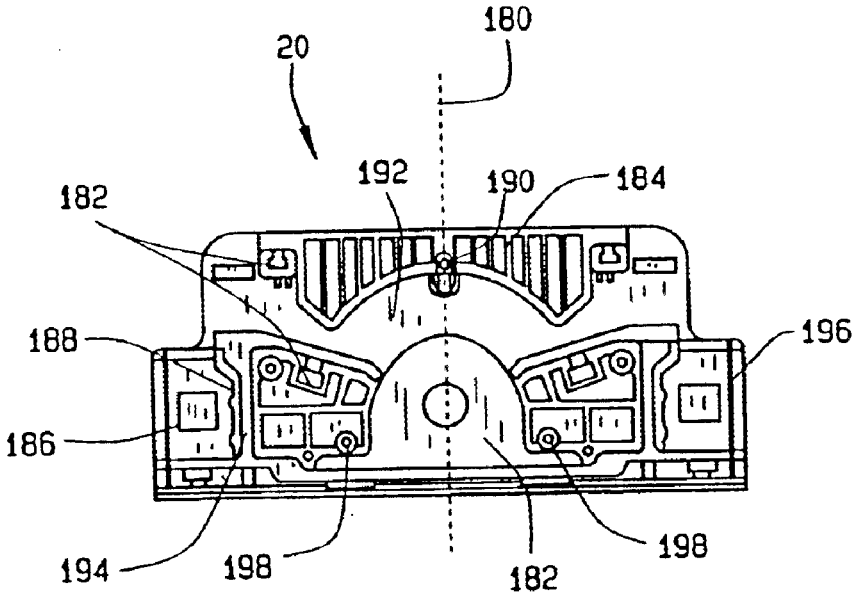
FIG. 11 is a diagram of a phase plate.

Referring to FIG. 11, phase plate 20 is symmetrically configured about a centerline 180. Plate 20 includes compartmentalized areas 182 for mating switch parts and for parts-mating hardware insertion. Plate 20 includes integral reinforcing ribs 184, built-in pads 186 for prevention of lug rotation, and integral cable stops 188 for controlled cable installation. A single top attachment point 190 facilitates top access for inspection and/or removal of stationary contact pads 56 (shown in FIG. 2).

A movable contact area 192 allows for mid-position holding by finger 90 for delayed transition. Sectioned areas 194 are provided for rear bus attachment features (not shown) for use on upper and/or lower bypass panels (not shown). Baffle guides 196 are provided for installing debris screens (not shown) to capture wire fragments and/or other foreign objects in e.g. bypass panels (not shown). Interlocking pins 198 allow full nesting of parts, e.g. arc chute assembly 40, main bus assemblies 32 and load bus assembly 34, between phase plates 20. Thus modular configuration of e.g. two-, three- and/or four-pole switches is contemplated.

Figure 12:
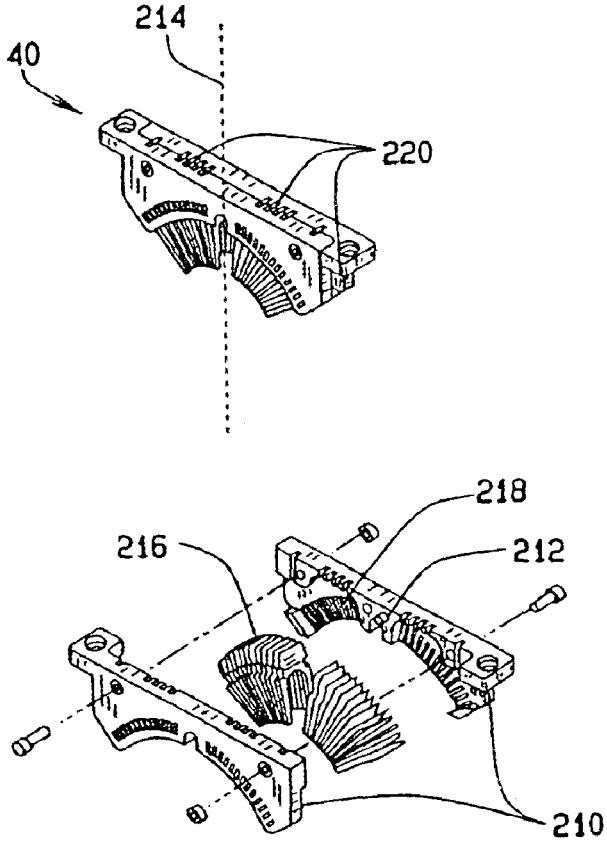
FIG. 12 is a diagram of an arc chute assembly.

FIG. 12 is an illustration of arc chute assembly 40. Assembly 40 in one embodiment is fabricated as molded thermoset plastic. Assembly 40 includes two identical plates 210, which are reversed for assembly and connected by single-locating pins 212 to ensure lineup of parts. Assembly 40 is symmetrical about a centerline 214. A plurality of deion plates 216 are locked in locking locations 218 embedded in assembly halves 210.

Arc chute assembly 40 extends (as shown in FIG. 2) to enclose stationary contact points 56 (shown in FIG. 3). Upper and lower venting orifices 220 allow for controlled expulsion of gases during arc interrupting operations as further described below.

Figure 13:
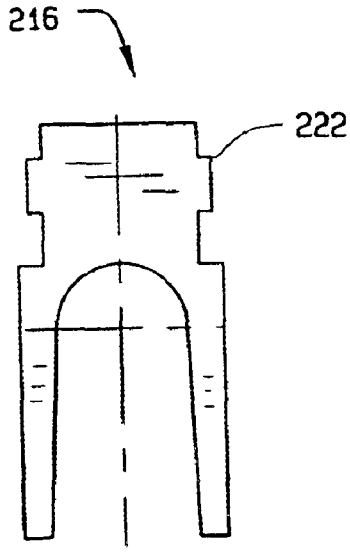
FIG. 13 is a diagram of a deion plate.

Referring to FIG. 13, deion plate 216 is fabricated in a single piece and includes keyed elements 222 that lock into locking locations 218 embedded in assembly halves 210 without additional hardware. Deion plates 216 provide coverage of finger 90 over a full swing, e.g. 106 degrees, of movable contact assembly 46 between stationary contacts 56.

Figure 14:
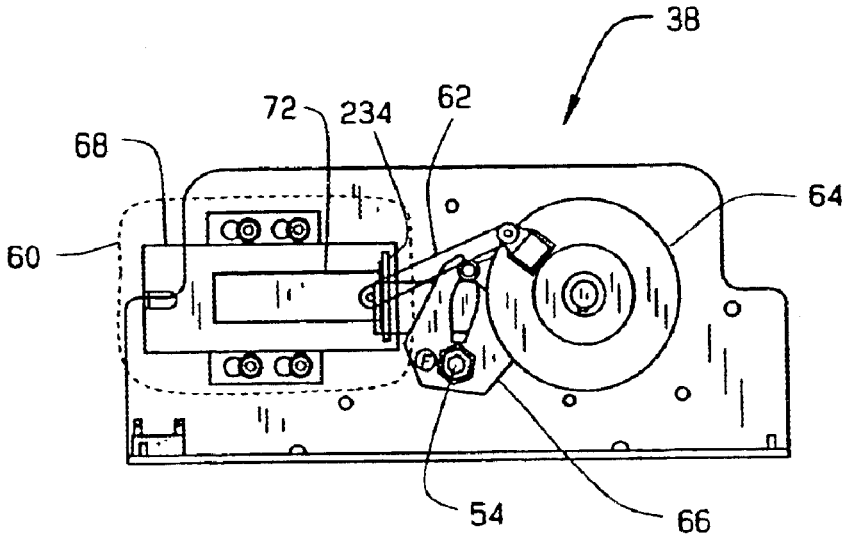
FIG. 14 is a diagram of a mechanical drive assembly.

FIG. 14 illustrates mechanical drive assembly 38. Spring 70 (shown in FIG. 4) is retained inside solenoid 68 by a washer 234 and provides a spring force to allow transfer switch 10 to transfer from one to the other of power sources 12 and 14 as further described below.

Figure 15:
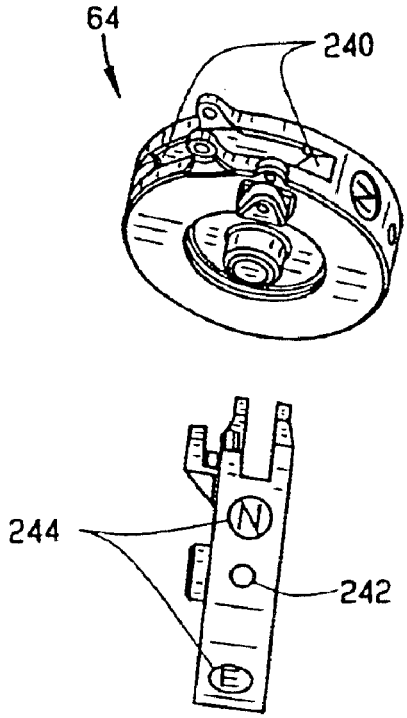
FIG. 15 is a diagram of a mass/momentum driver assembly.

FIG. 15 illustrates mass/momentum driver assembly 64. Assembly 64 is movably connected to fork assembly 66 and includes cast-in stopping surfaces 240 which, together with fork assembly 66, aid in bringing assembly 64 to a stop. Assembly 64 also includes a manual handle insertion point 242 for manual operation of switch 10 e.g. under no-load conditions, and positional indicators 244 showing e.g. an "N" for a normal source and an "E" for an emergency source. Thus contact positions are announced, e.g. during manual operation or when control processor annunciation is unavailable.

Figure 16:
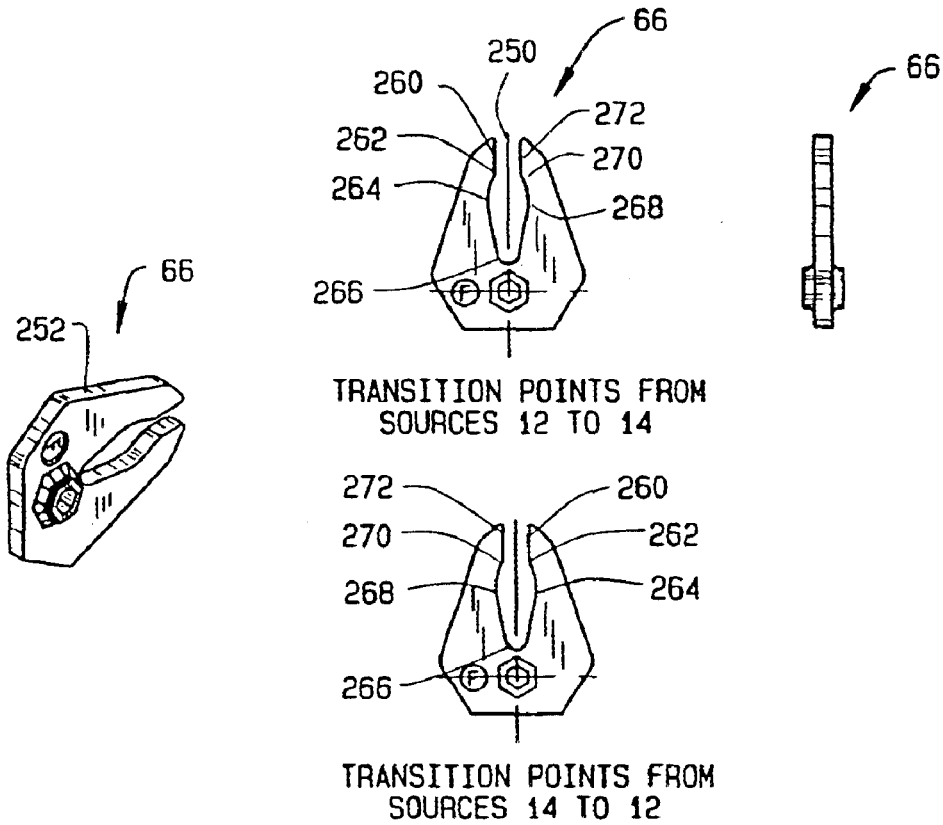
FIG. 16 is a diagram of a fork assembly.

FIG. 16 illustrates fork assembly 66, which is fabricated as a single piece symmetrical about a centerline 250. Fork 56 includes a plurality of mechanical stopping surfaces 252. When switch 10 is in operation, and referring to FIG. 16, fork assembly 66, via cooperating stopping surfaces 252 and 240, assists in controlling motion of current carrying components of switch 10. Internal geometry of fork 66 allows for a series of transition points, further described below, as movable contact assembly 46 moves between main bus assemblies 32.

More particularly and for example, a single rotation of mass driver assembly 64, aided through a lateral pull of solenoid 68 (shown in FIG. 4), allows transfer switch 10 to rotate movable contact assembly 46 mounted on common shaft 54 between main bus assemblies 32. Referring to FIG. 16, at a transition point 260, switch 10 is closed into a power source, for example, source 12. At a transition point 262, movable contact assemblies 46 are driven from a closed state to an open state, allowing an arc created within arc chute 40 to extinguish itself. At a transition point 264, operation of movable contact assembly 46 is slowed down to ensure total extinguishing of the arc.

Figure 17:
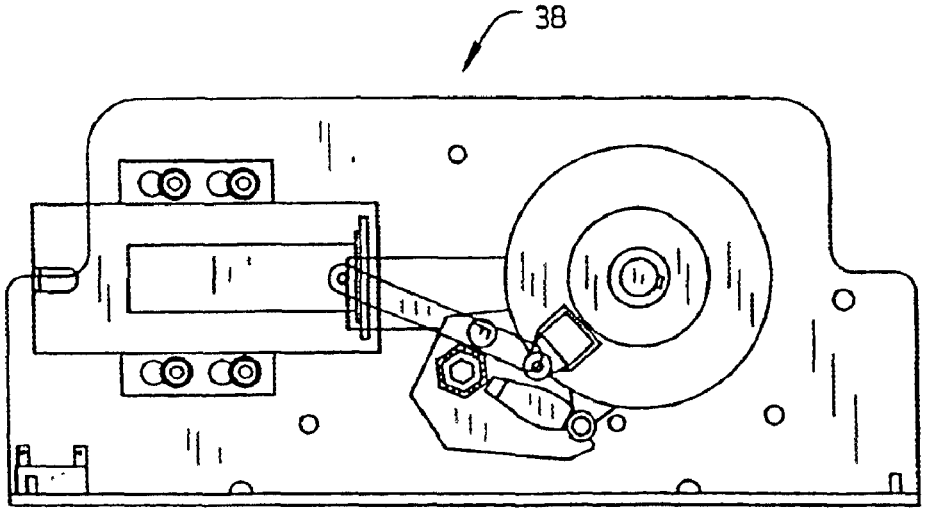
FIG. 17 is a diagram of a mechanical drive assembly after contact rotation.

At a transition point 266, solenoid power is terminated, allowing energy stored within spring 70 to drive movable contact assemblies 46 to contact main bus assemblies 32 for source 14. At a transition point 268, movable contact assemblies 46 approach main bus assemblies 32 for source 14. At a transition point 270, angular velocity of movable contact assemblies 46 accelerates. At a transition point 272, movable contact assemblies 46 have completed connection to source 14 and contact forces have ramped up to nominal values. FIG. 17 illustrates mechanical drive assembly 38 after rotation of movable contact assemblies 46. The above described process is reversed when switch 10 transfers from source 14 to source 12.

Figure 18:
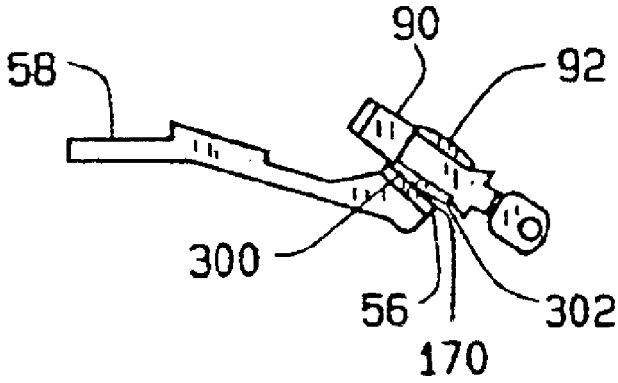
FIG. 18 is an illustration of "toe-heel, heel-toe" sweeping action between stationary and movable contact pads.

Stationary pads 56 and movable pads 92 contact one another in a "toe-heel, heel-toe" sweeping action. More specifically and referring to FIG. 18, as contact finger 90 closes into a source contact 56, a "toe" edge 300 of movable pad 92 is the first part of pad 92 to touch stationary pad 56. Additional rotation of carrier 82 (shown in FIG. 5) allows for additional compression of contact springs 96 (shown in FIG. 5), which aids in rotation of pad 92 from "toe" edge 300 to a "heel" edge 302. When carrier 82 has rotated to a toggle-lock position, springs 96 compress further and allow movable contact 92 to slide on surface 170 of pad 56. Such sliding action serves to clear contacts 56 and 92 of impurities. When finger 90 comes to a rest position on heel edge 302, contact forces are established and current flows between contacts 56 and 92.

A reverse "heel-toe" sweeping action occurs when finger 90 opens out of source contact 56. More specifically, when carrier 82 begins to rotate, springs 96 de-compress and allow finger 90 to rotate such that toe edge 300 is last to leave surface 170. Such sliding action serves to clear contacts 56 and 92 of impurities and also aids in extinguishing the above described arc.

In one embodiment of switch 10 configured to transfer phase currents and a neutral current, thickness 172 of stationary contact pad 56 (shown in FIG. 10) associated with the neutral current is greater than thickness 172 of stationary contact pad 56 associated with the phase currents. Thus when movable contacts 92 close into source contacts 56, connection with the neutral current occurs before connection with the phase currents. When movable contacts 92 open out of source contacts 56, phase contacts 92 part from source contacts 56 before neutral contact 92. Such sequencing prevents unbalanced currents from being transferred to load 16.

Thus the above-described transfer switch provides for establishment of contact forces at each contact pad, with little or no manufacturing adjustment. Hexagonal configuration of shaft 54 distributes forces and stress risers in such a manner that shaft strength is increased while point loads on mating parts are reduced. Because limit switch operating cam 76 is mounted on common shaft 54, a single motion of the mechanical drive assembly 38 is effective both to transfer a load and to generate annunciation of the transfer. Cam 76, in controlling limit switches 78, performs a role typically performed by four separate components in known transfer switches.

The above described transfer switch allows for two, three and four-pole modular configuration with minimal additional hardware. Symmetrical and one-piece design of parts such as phase plates 20 facilitates reduction of a number of parts and allows for cost reduction through use of processes such as extrusion.

While the invention has been described in terms of various specific embodiments, those skilled in the art will recognize that the invention can be practiced with modification within the spirit and scope of the claims.

What is claimed is:

1. A transfer switch for switching between power sources for a load, said transfer switch comprising:

a plurality of phase plates, each said phase plate comprising a centerline about which said phase plate is configured symmetrically;

a plurality of stationary contact pads associated with each said phase plate, each said stationary contact pad associated with a power source;

a movable contact assembly associated with each said phase plate, wherein said movable contact assembly includes a movable finger attached to a braid assembly; and a shaft connecting said phase plates and upon which each said movable contact assembly is mounted for movement between said stationary contact pads associated with each said phase plate.

2. A transfer switch in accordance with claim 1 further comprising movable contact pads mounted on said movable finger, wherein one of said movable contact pads comprises silver and tungsten.

3. A transfer switch in accordance with claim 2 wherein said braid assembly comprises a single-piece braid and mounting ports configured to prevent rotation of said braid assembly.

4. A transfer switch in accordance with claim 2 further comprising a mechanical drive assembly configured to rotate said movable finger, wherein said mechanical drive assembly further comprises a solenoid assembly, a fork assembly and a mass driver assembly, said solenoid assembly linked to said mass driver assembly, said mass driver assembly movably connected to said fork assembly.

5. A transfer switch in accordance with claim 2 further comprising a mechanical drive assembly configured to rotate said movable finger, wherein said mechanical drive assembly includes a fork assembly, wherein said fork assembly comprises a centerline about which said fork assembly is symmetrical.

6. A transfer switch in accordance with claim 2 further comprising a mechanical drive assembly configured to rotate said movable finger, wherein said mechanical drive assembly includes a mass driver assembly, wherein said mass driver assembly further comprises a manual handle insertion point and positional indicators.

7. A transfer switch in accordance with claim 1 further comprising movable contact pads mounted on said movable finger, wherein one of said movable contact pads further comprises forty percent silver and sixty percent tungsten.

8. A transfer switch in accordance with claim 7 wherein said movable contact assembly further comprises a carrier cover, said cover further comprising embedded alignment features.

9. A transfer switch in accordance with claim 7 wherein said movable contact assembly further comprises a carrier, and said carrier comprises an acceptance hole for said shaft.

10. A transfer switch in accordance with claim 7 wherein said movable contact assembly further comprises a carrier, said carrier includes an acceptance hole for said shaft, and said acceptance hole is hexagonal.

11. A transfer switch in accordance with claim 7 wherein said movable contact assembly further comprises a carrier, and said carrier comprises integral baffling.

12. A transfer switch in accordance with claim 7 wherein said movable contact assembly further comprises a carrier cover and a carrier, and said carrier and said cover comprise braid shields.

13. A transfer switch in accordance with claim 1 further comprising movable contact pads mounted on said movable finger, wherein one of said movable contact pads comprises a curved surface.

14. A transfer switch in accordance with claim 13 further comprising a plurality of arc chute assemblies, wherein said phase plates are associated with said arc chute assemblies, and one of said arc chute assemblies further comprises two identical arc chute plates reversible for assembly.

15. A transfer switch in accordance with claim 14 wherein said arc chute plates comprise molded thermoset plastic.

16. A transfer switch in accordance with claim 13 further comprising a plurality of arc chute assemblies, wherein said phase plates are associated with said arc chute assemblies, and one of said arc chute assemblies further comprises a plurality of deion plates locked in a plurality of embedded locking locations.

17. A transfer switch in accordance with claim 13 further comprising a plurality of arc chute assemblies, wherein said phase plates are associated with said arc chute assemblies, and one of said arc chute assemblies further comprises a plurality of venting orifices.

18. A transfer switch in accordance with claim 1 further comprising movable contact pads mounted on said movable finger, wherein one of said movable contact pads comprises a waffle-patterned brazed surface.

19. A transfer switch in accordance with claim 1 further comprising movable contact pads mounted on said movable finger, wherein one of said movable contact pads comprises a surface brazed using a BcuP5 alloy.

20. A transfer switch in accordance with claim 1 wherein one of said stationary contact pads further comprises 50 percent silver, 37.5 percent tungsten, and 12.5 percent tungsten carbide.

21. A transfer switch in accordance with claim 1 wherein one of said stationary contact pads comprises a surface brazed using a BcuP5 alloy.

22. A transfer switch in accordance with claim 1 further comprising movable contact pads mounted on said movable finger, wherein said movable finger configured to bring one of said movable contact pads into contact with one of said stationary contact pads using a sweeping action.

23. A transfer switch in accordance with claim 1 further comprising movable contact pads mounted on said movable finger, wherein said movable finger configured to remove one of said movable contact pads from contact with one of said stationary contact pads using a sweeping action.

24. A transfer switch in accordance with claim 1 wherein said stationary contact pads are associated with phase currents and a neutral current, and wherein each of said stationary contact pads further comprises a first thickness, said first thickness associated with the neutral current greater than second thickness associated with the phase currents.

25. A transfer switch in accordance with claim 1 wherein said braid assembly comprises a single-piece braid.

26. A transfer switch in accordance with claim 1 wherein said braid assembly comprises a single-piece braid onto which ferrules are slipped and crimped.

27. A transfer switch for switching between power sources for a load, said transfer switch comprising:

a plurality of phase plates, each said phase plate comprising a centerline about which said phase plate is configured symmetrically;

a plurality of stationary contact pads associated with each said phase plate, each said stationary contact pad associated with a power source;

a movable contact assembly associated with each said phase plate, wherein said movable contact assembly includes a movable finger;

a shaft connecting said phase plates and upon which each said movable contact assembly is mounted for movement between said stationary contact pads associated with each said phase plate; and a mechanical drive assembly configured to rotate said movable finger, wherein said mechanical drive assembly includes a fork assembly and a mass driver assembly, wherein said mass driver assembly and said fork assembly each comprise a plurality of stopping surfaces, said stopping surfaces configured to cooperate in controlling motion of said mechanical drive assembly.

28. A transfer switch for switching between power sources for a load, said transfer switch comprising:

a plurality of phase plates, each said phase plate comprising a centerline about which said phase plate is configured symmetrically;

a plurality of stationary contact pads associated with each said phase plate, each said stationary contact pad associated with a power source;

a movable contact assembly associated with each said phase plate;

a shaft connecting said phase plates and upon which each said movable contact assembly is mounted for movement between said stationary contact pads associated with each said phase plate; and a fork assemble, wherein said fork assembly comprises an internal geometry allowing for a series of transition points based on movement of movable contacts between said stationary contact pads.

* * * * *

UNITED STATES PATENT AND TRADEMARK OFFICE

CERTIFICATE OF CORRECTION

PATENT NO. : 6,849,811 B1
APPLICATION NO. : 09/629244
DATED : February 1, 2005
INVENTOR(S) : Heflin et al.

It is certified that error appears in the above-identified patent and that said Letters Patent is hereby corrected as shown below:

In Claim 24, column 7, line 46, delete "than second thickness" and insert therefor -- than a second thickness --.

In Claim 28, column 8, line 43, delete "assemble" and insert therefor -- assembly --.

Signed and Sealed this

Thirteenth Day of February, 2007

JON W. DUDAS
*Director of the United States Patent and Trademark Office*